US008048290B2

(12) United States Patent
Knuuttila et al.

(10) Patent No.: US 8,048,290 B2
(45) **Date of Patent: *Nov. 1, 2011**

(54) PROCESS FOR PRODUCING BRANCHED HYDROCARBONS

(75) Inventors: Pekka Knuuttila, Porvoo (FI); Eija Koivusalmi, Kulloonkylä (FI); Pekka Aalto, Porvoo (FI); Rami Piilola, Helsinki (FI)

(73) Assignee: Neste Oil Oyj, Espoo (FI)

( * ) Notice: Subject to any disclaimer, the term of this patent is extended or adjusted under 35 U.S.C. 154(b) by 657 days.

This patent is subject to a terminal disclaimer.

(21) Appl. No.: 12/137,229

(22) Filed: Jun. 11, 2008

(65) Prior Publication Data

US 2009/0014354 A1 Jan. 15, 2009

Related U.S. Application Data

(60) Provisional application No. 60/943,182, filed on Jun. 11, 2007.

(51) Int. Cl.
*C10M 101/00* (2006.01)
*C10M 177/00* (2006.01)
*C10G 71/00* (2006.01)

(52) U.S. Cl. ..... 208/64; 208/18; 208/63; 585/734; 585/737

(58) Field of Classification Search ..... 208/18, 208/62–64, 66; 585/310, 734, 737
See application file for complete search history.

(56) References Cited

U.S. PATENT DOCUMENTS

| | | | | |
|---|---|---|---|---|
| 4,678,860 | A | 7/1987 | Kuester | |
| 4,935,570 | A | 6/1990 | Nelson et al. | |
| 5,705,722 | A | 1/1998 | Monnier et al. | |
| 5,777,183 | A | 7/1998 | Mueller et al. | |
| 7,087,152 | B2 | 8/2006 | Cody et al. | |
| 7,232,935 | B2 * | 6/2007 | Jakkula et al. | 585/240 |
| 2001/0004972 | A1 | 6/2001 | Miller et al. | |
| 2003/0102254 | A1 * | 6/2003 | Eijsbouts et al. | 208/216 R |
| 2006/0207166 | A1 * | 9/2006 | Herskowitz et al. | 44/385 |
| 2007/0135663 | A1 * | 6/2007 | Aalto et al. | 585/1 |

FOREIGN PATENT DOCUMENTS

| | | |
|---|---|---|
| EP | 457665 | 11/1991 |
| EP | 0985010 | 3/2000 |
| EP | 1549725 | 7/2005 |
| EP | 1810961 | 7/2007 |
| FI | 100248 | 10/1997 |
| WO | WO-2004/080590 A1 | 9/2004 |
| WO | WO-2006/100584 A2 | 9/2006 |

OTHER PUBLICATIONS

Kelly, G.J. et al., "Waste Elimination in Condensation Reactions of Industrial Importance," Green Chemistry, 2002, vol. 4, p. 392-399.

Durand, R. et al., "Heterogeneous Hydrodeoxygenation of Ketones and Alcohols on Sulfided NiO-$MoM_3$/γ-$Al_2O_3$ Catalyst," Journal of Catalysis, 90 (1), 1984, p. 147-149.

* cited by examiner

*Primary Examiner* — Walter Griffin
*Assistant Examiner* — Renee E Robinson
(74) *Attorney, Agent, or Firm* — Birch, Stewart, Kolasch & Birch, LLP

(57) ABSTRACT

The invention relates to a process for producing base oils, comprisings the steps where feedstock selected from ketones, aldehydes, alcohols, carboxylic acids, esters of carboxylic acids and anhydrides of carboxylic acids, alpha olefins, metal salts of carboxylic acids and corresponding sulphur compounds, corresponding nitrogen compounds and combinations thereof, is subjected to a condensation step and subsequently subjected to a combined hydrodefunctionalization and isomerization step.

12 Claims, 4 Drawing Sheets

PROCESS FOR PRODUCING BRANCHED HYDROCARBONS

This application is a Non-Provisional which claims priority of Application No. 60/943,182 filed in United States of America on Jun. 11, 2007 under 35 U.S.C. §119; the entire contents of all are hereby incorporated by reference.

FIELD OF THE INVENTION

The invention relates to a process for producing branched saturated hydrocarbons and particularly high quality saturated base oils based on biological raw materials. The process comprises steps wherein a feedstock of biological origin is condensed and then subjected to a combined catalytic hydrodefunctionalization and isomerization step.

STATE OF THE ART

Base oils are commonly used for the production of lubricants, such as lubricating oils for automotives, industrial lubricants and lubricating greases. They are also used as process oils, white oils and metal working oils. Finished lubricants generally consist of lubricating base oils and additives. Base oils are the major constituents in finished lubricants and they contribute significantly to the properties of the finished lubricants.

Base oils of Group III or IV according to the classification of the American Petroleum Institute (API) are today used in high quality lubricants. Base oils of Group III are base oils with very high viscosity indices (VHVI), produced by modern methods from crude oil by hydrocracking and/or isomerization of waxy linear paraffins to give branched paraffins having the desired molecular size and weight distribution to achieve low volatility and improved cold flow properties. Base oils of Group III also include base oils produced from Slack Wax paraffins based on processed fractions of mineral oils, and from gas to liquids (GTL) and (biomass to liquid) BTL waxes obtained by Fischer-Tropsch synthesis. High quality base oils in Group IV are synthetic poly alpha olefins (PAO), having a well controlled star like molecular structure and extreme narrow molecular weight distribution.

A similar classification is also used by ATIEL (Association Technique de l'Industrie Européenne des Lubrifiants, or Technical Association of the European Lubricants Industry), said classification also comprising Group VI: Poly internal olefins (PIO). In addition to the official classifications, also Group II+ is commonly used in this field, this group comprising saturated and sulfur-free base oils having viscosity indices of more than 110, but below 120. According to these classifications saturated hydrocarbons include paraffinic and naphthenic compounds, but not aromatics. The API base oils classification is shown in the following Table 1.

TABLE 1

API base oil classification

| Group | Saturated hydrocarbons wt-% (ASTM D 2007) | Sulfur, wt-% (ASTM D 1552/D 2622/ D 3120/D4294/D 4927) | Viscosity index (VI) (ASTM D 2270) |
|---|---|---|---|
| I | <90 and/or | >0.03 | 80 ≦ VI < 120 |
| II | ≧90 | ≦0.03 | 80 ≦ VI < 120 |
| III | ≧90 | ≦0.03 | ≧120 |
| IV | All poly alpha olefins (PAO) | | |
| V | All other base oils not belonging to Groups I-IV | | |

There is also available a definition for base stocks according to API 1509 as: "A base stock is a lubricant component that is produced by a single manufacturer to the same specifications (independent of feed source or manufacturer's location); that meets the same manufacturer's specification; and that is identified by a unique formula, product identification number, or both. Base stocks may be manufactured using a variety of different processes." Base oil is the base stock or blend of base stocks used in API-licensed oil. The known base stock types are 1) Mineral oil (paraffinic, naphthenic, aromatic), 2) Synthetic oil (poly alpha olefins, alkylated aromatics, diesters, polyol esters, poly alkylene glycols, phosphate esters, silicones), and 3) Plant oil.

Already for a long time, particularly the automotive industry has required lubricants and thus base oils with improved technical properties. Increasingly, the specifications for finished lubricants require products with excellent low temperature properties, high oxidation stability and low volatility. Generally lubricating base oils are base oils having kinematic viscosity of about 3 $mm^2/s$ or greater at 100° C. (KV100, kinematic viscosity measured at 100° C.); pour point (PP) of about −12° C. or less; and viscosity index (VI) about 120 or greater. In addition to low pour point, also low-temperature fluidity of multi-grade engine oils is required to guarantee that in cold weather the engine starts easily.

It is generally desired that lubricant service life would be as long as possible, thus avoiding frequent engine oil changes by the end user and further, allowing extended maintenance intervals of vehicles. Engine oil change intervals for passenger cars have during the past years increased about five fold, being at best 50 000 km. For heavy vehicles, engine oil change intervals are at present already in the order of 100 000 km. At the same time regulations controlling the use of additives for improving oil performance are tightened.

Anti-wear additives generally used are organic metal salts, such as zinc dialkyl dithio phosphates, which are usually abbreviated as ZDDP, ZnDTP or ZDP. Typically the percentage of ZDDP additives in mineral oil based motor lubricants ranges approximately between 2 and 15% by weight. The purpose of the high percentages of additives is to compensate insufficient quality of base oils.

Further, mineral oil based Group I and II base oils often contain unacceptably high concentrations of aromatic, sulphur and nitrogen compounds, and further, they also have high volatility and a modest viscosity index (VI), that is viscosity-temperature dependence. However, increased use of catalytic converters and particle filters in vehicles restrict the use of sulphur, phosphorous and metal containing additives or base oils containing such compounds in the manufacture of high quality motor lubricants.

The use of recycled oils and renewable raw materials, in the production of lubricants has become an object of interest. For the time being, only esters are used in commercial lubricants of biological origin. The use of esters is limited to a few special applications, such as oils for refrigeration compressor lubricants, biodegradable hydraulic fluids, chain saw oils and fluids for metal processing. Because of instability of ester based base oils, their use is limited mainly to additive scale.

Starting materials originating from biological sources contain usually high amounts of oxygen, and as examples of oxygen containing compounds fatty acids, fatty acid esters, aldehydes, primary alcohols and their derivatives can be mentioned. EP 457,665 discloses a method for producing ketones from triglycerides, fatty acids, fatty acid esters, fatty acid salts, and fatty acid anhydrides using a bauxite catalyst containing iron oxide. A process for condensing alcohols using alkali metal or alkaline earth metal hydroxides with metal oxide co-catalyst to give Guerbet alcohols is disclosed in U.S. Pat. No. 5,777,183. Methods for producing unsaturated and branched aldehydes or ketones having longer hydrocarbon chains are available starting from aldehydes and ketones using aldol condensation reaction. Basic homogeneous catalysts, such as NaOH and $Ca(OH)_2$, and supported alkali metals like $Na/SiO_2$ are examples of heterogeneous catalysts for condensing aldehydes, as described by Kelly, G. J. et al., Green Chemistry, 2002, 4, 392-399.

Acid stable aldehydes and ketones can be reduced to corresponding hydrocarbons by the Clemmensen reduction. A mixture of amalgamated zinc and hydrochloric acid is used as deoxygenation catalyst. However, the above described strongly acidic amalgam catalyst system is not suitable for base oil production on an industrial scale. In addition to strong acidity and batch process, potential uncontrollable side reactions, such as alkylation, cracking and isomerization are related to this reaction.

Durand, R. et al., *Journal of Catalysis* 90(1) (1984), 147-149 describe hydrodeoxygenation of ketones and alcohols on sulfided NiO—$MoO_3/\gamma$-$Al_2O_3$ catalyst to produce corresponding paraffins. In U.S. Pat. No. 5,705,722 a process is described for producing additives for diesel fuels from biomass feedstock such as tall oil, wood oils, animal fats and blends of tall oil with plant oil under hydroprocessing conditions in the presence of a CoMo or NiMo catalyst to obtain a product mixture.

In hydrodeoxygenation processes conventional hydroprocessing catalysts are used, particularly NiMo and CoMo based catalysts, maintained in their sulfided form in order to remain active at process conditions commonly using added small $H_2S$ co-feed. However, as there exists a general need to decrease the use of sulphur, particularly because of environmental reasons, use of these catalysts is not desirable.

Products obtained in the above mentioned processes are essentially n-paraffins solidifying at subzero temperatures and as such they are unsuitable for base oils.

FI 100248 discloses a process comprising the steps wherein middle distillate is produced from plant oil by hydrogenation of carboxylic acids or triglycerides of plant oils to yield linear normal paraffins, followed by isomerization of said n-paraffins to give branched paraffins. Both process steps require different catalysts and separate process units, which increase the overall costs and also decrease the yields.

In WO 2006/100584 a process for the production of diesel fuel from plant oils and animal fats is disclosed, comprising hydrodeoxygenating and hydroisomerizing the feed oil in a single step. In addition, in U.S. Pat. No. 7,087,152 a process is disclosed where oxygenate containing, waxy mineral hydrocarbon feed or Fischer-Tropsch wax is dewaxed using a dewaxing catalyst, which is selectively activated by the oxygenate added to the feed. European Patent EP 1 549725 relates to an integrated catalytic hydrodewaxing process for processing hydrocarbon feedstock containing sulphur and nitrogen contaminants, including hydrotreating, hydrodewaxing (i.e. hydroisomerization) and/or hydrofinishing without disengagement between the process steps.

There is an apparent need for a new efficient process for producing branched saturated hydrocarbons and particularly high quality saturated base oils, utilizing renewable feed stocks and resulting in high quality base oils, fulfilling the most demanding technical requirements and being suitable for lubricants and engine oils without extensive use of additives.

OBJECTS OF THE INVENTION

An object of the invention is a process for producing branched saturated hydrocarbons.

Another object of the invention is a process for producing saturated base oils.

Still another object of the invention is a process for producing saturated base oils using starting materials of biological origin.

Still another object of the invention is a process for producing base oils, wherein feedstock derived from biological starting material is condensed, followed by a combined hydrodefunctionalization and isomerization step.

DEFINITIONS

Carboxylic acids and derivatives thereof include fatty acids and derivatives thereof. Carbon number of fatty acids and their derivatives is at least C4. Thus, after the condensation reaction of the invention the chain length of the reaction product is at least C18. Carboxylic acids marked for example C18:1 means C18 chain with one double bond.

The term "saturated hydrocarbon", used herein refers to paraffinic and naphthenic compounds, but not to aromatic compounds. Paraffinic compounds may either be linear (n-paraffins) or branched (i-paraffins).

Saturated base oils comprise here saturated hydrocarbons.

Naphthenic compounds refer to cyclic saturated hydrocarbons, i.e. cycloparaffins. Such hydrocarbon with cyclic structure is typically derived from cyclopentane or cyclohexane. A naphthenic compound may comprise a single ring structure (mononaphthene) or two isolated ring structures (isolated dinaphthene), or two fused ring structures (fused dinaphthene) or three or more fused ring structures (polycyclic naphthenes or polynaphthenes).

Condensation refers here to a type of reaction in which two feedstock molecules combine to form a larger molecule. In condensation the carbon chains of the feedstock molecules is lengthened to the level necessary for the base oils, typically to hydrocarbon chain lengths of at least C18.

Hydrodefunctionalization (HDF) refers here to removal of oxygen, sulphur and nitrogen atoms by means of hydrogen. The structure of the biological starting material will be converted to be either paraffinic or olefinic, according to the catalyst and reaction conditions used. The HDF step converts oxygen, nitrogen and sulphur containing contaminants to water, ammonia and hydrogen sulphide respectively.

Isomerization refers here to hydroisomerization of linear hydrocarbons (n-paraffins) resulting in branched hydrocarbons (i-paraffins).

Combined hydrodefunctionalization and isomerization step (CHI) refers here to removal of oxygen, nitrogen and sulphur atoms by means of hydrogen and isomerizing waxy molecules to branched isomerates (hydrocarbons).

In this context, pressures are gauge pressures relative to normal atmospheric pressure.

Classification of the periodic table of the elements is the IUPAC Periodic Table format having Groups from 1 to 18.

In this context, width of carbon number range refers to the difference of the carbon numbers of the largest and the smallest molecules plus one, measured from the main peak in FIMS analysis of the product.

SUMMARY OF THE INVENTION

The process according to the invention, for the manufacture of branched saturated hydrocarbons, and particularly high quality saturated base oils based on biological raw materials, comprises the steps wherein feedstock derived from starting material of biological origin is subjected to a condensation step, yielding a condensed product comprising hydrocarbons containing one or more heteroatoms selected from oxygen, sulphur and nitrogen, and the condensed product is then subjected to a combined hydrodefunctionalization and isomerization step (CHI), whereby simultaneously isomerization takes place and heteroatoms are removed in a single process step.

The invention is illustrated with the appended Figures without wishing to limit the scope of the invention to the embodiments of said figures.

In FIG. 1 a preferable embodiment of the invention is shown schematically. In the process the condensation step is carried out prior to the combined hydrodefunctionalization and isomerization step. From the feed tank 1, heteroatoms containing feedstock stream 2 is passed to condensation reactor 3, followed by passing of the condensed stream 4 to a combined hydrodefunctionalization and isomerization reactor 5, together with hydrogen gas 6. Excess of hydrogen and hydrogenated heteroatoms are removed as gaseous stream 7. The obtained branched paraffinic stream 8 is passed to distillation and/or separation unit 9, where product components boiling at different temperature ranges, gases 10, gasoline 11, diesel 12, and base oil 13 are separated. Part of the condensation product (4*a*) may also be recycled back to the condensation reactor 3, particularly if it is desired to produce heavier base oil components with carbon number twice of that of the first condensation product.

The distillation cuts of different fractions may vary. Typically gases comprise C1-C4 hydrocarbons boiling in the range −162-36° C., gasoline comprises C5-C10 hydrocarbons boiling in the range 36-180° C., diesel fuel comprises C11-C23 hydrocarbons boiling in the range 180-380° C. and base oil comprises at least C18, hydrocarbons boiling in the range above 316° C. Base oils may also be presented as subgroups: process oils C18-26 boiling in the range of 316-413° C., preferably process oils comprise C21-26 hydrocarbons and base oils>C26 hydrocarbons boiling above 413° C.

DETAILED DESCRIPTION OF THE INVENTION

Figure 1:
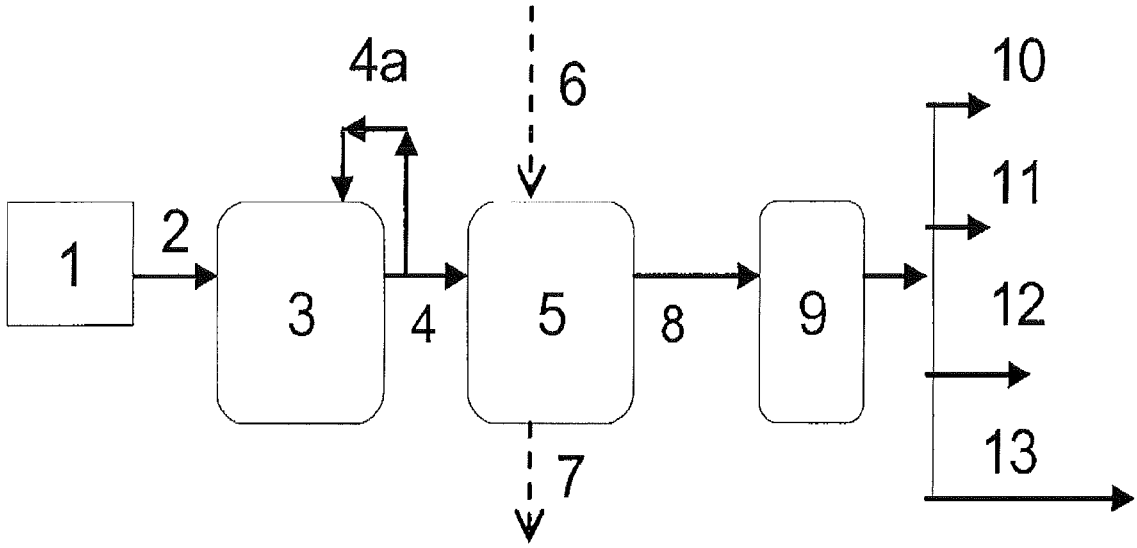
FIG. 1 is a schematic presentation of an embodiment of the process of the invention.

It was surprisingly found that high quality base oil, comprising branched saturated hydrocarbons with carbon number of at least C18, preferably C21-C48 is obtained by the process according to the invention wherein feedstock derived from starting material of biological origin is condensed and subsequently subjected to combined hydrodeoxygenation and isomerization step, where the hydrodeoxygenation and isomerization reactions can be successfully performed simultaneously in the same reactor in the presence of hydrogen and a catalyst having both an acidic function and a hydrogenation function. The catalyst typically comprises a combination of molecular sieve and metal.

Feedstock to Condensation

The feedstock of the condensation step is material derived from starting material of biological origin. The feedstock is selected from ketones, aldehydes, alcohols, carboxylic acids, esters of carboxylic acids and anhydrides of carboxylic acids, alpha olefins produced from carboxylic acids, metal salts of carboxylic acids, and corresponding sulphur compounds, corresponding nitrogen compounds and combinations thereof, originating from biological starting material. The selection of the feedstock depends on the type of the condensation reaction used.

Preferably the feedstock is selected from fatty acid esters, fatty acid anhydrides, fatty alcohols, fatty ketones, fatty aldehydes, natural waxes, and metal salts of fatty acids. In the condensation step, also di- or multifunctional feedstocks such as dicarboxylic acids or polyols including diols, hydroxyketones, hydroxyaldehydes, hydroxycarboxylic acids, and corresponding di- or multifunctional sulphur compounds, corresponding di- or multifunctional nitrogen compounds and combinations thereof may be used. The carbon number of the carboxylic acids and their derivatives is at least C4, preferably C12-C24 and the feedstock materials are selected such that the carbon number of the obtained condensed product is at least C18, preferably C21-C48 but even heavier base oil components may also be produced if desired.

The feedstock originating from starting material of biological origin, called biological starting material in this description is selected from the group consisting of:

a) plant fats, plant oils, plant waxes; animal fats, animal oils, animal waxes; fish fats, fish oils, fish waxes, and
b) fatty acids or free fatty acids obtained from plant fats, plant oils, plant waxes; animal fats, animal oils, animal waxes; fish fats, fish oils, fish waxes, and mixtures thereof by hydrolysis, transesterification or pyrolysis, and
c) esters obtained from plant fats, plant oils, plant waxes; animal fats, animal oils, animal waxes; fish fats, fish oils, fish waxes, and mixtures thereof by transesterification, and
d) metal salts of fatty acids obtained from plant fats, plant oils, plant waxes; animal fats, animal oils, animal waxes; fish fats, fish oils, fish waxes, and mixtures thereof by saponification, and
e) anhydrides of fatty acids from plant fats, plant oils, plant waxes; animal fats, animal oils, animal waxes; fish fats, fish oils, fish waxes, and mixtures thereof, and
f) esters obtained by esterification of free fatty acids of plant, animal and fish origin with alcohols, and
g) fatty alcohols or aldehydes obtained as reduction products of fatty acids from plant fats, plant oils, plant waxes; animal fats, animal oils, animal waxes; fish fats, fish oils, fish waxes, and mixtures thereof, and
h) recycled food grade fats and oils, and fats, oils and waxes obtained by genetic engineering, and
i) mixtures of said starting materials.

Biological starting materials also include corresponding compounds derived from algae, bacteria and insects as well as starting materials derived from aldehydes and ketones prepared from carbohydrates.

Examples of suitable biological starting materials include fish oils such as Baltic herring oil, salmon oil, herring oil, tuna oil, anchovy oil, sardine oil, and mackerel oil; plant oils such as rapeseed oil, colza oil, canola oil, tall oil, sunflower seed oil, soybean oil, corn oil, hemp oil, linen seed oil, olive oil, cottonseed oil, mustard oil, palm oil, peanut oil, castor oil, Jatropha seed oil, *Pongamia pinnata* seed oil, palm kernel oil, and coconut oil; and moreover, suitable are also animal fats such as lard and tallow, and also waste and recycled food grade fats and oils, as well as fats, waxes and oils produced by genetic engineering. In addition to fats and oils, suitable starting materials of biological origin include animal waxes such as bee wax, Chinese wax (insect wax), shellac wax, and lanoline (wool wax), as well as plant waxes such as carnauba palm wax, Ouricouri palm wax, jojoba seed oil, candelilla wax, esparto wax, Japan wax, and rice bran oil.

The biological starting material may also contain free fatty acids and/or fatty acid esters and/or metal salts thereof, or cross-linked products of the biological starting material. The metal salts are typically alkali earth metal or alkali metal salts.

Condensation

In the condensation step the feedstock is processed to monofunctional or multifunctional compounds having carbon number of at least C18.

Suitable condensation reactions are based on the functionality of the feed molecules, being decarboxylative condensation (ketonization), aldol condensation, alcohol condensation (Guerbet reaction), and radical reactions based on alpha-olefin double bonds and weak alpha-hydrogen functionality. The condensation reaction step is preferably selected from ketonization, aldol condensation, alcohol condensation and radical reactions. Suitable condensation reactions are described more in detail in the following.

Ketonization (Decarboxylative Condensation)

In the ketonization reaction the functional groups, typically the acid groups of fatty acids contained in the feedstock react with each other giving ketones having carbon number of at least C18. The ketonization may also be carried out with feedstock comprising fatty acid esters, fatty acid anhydrides, fatty alcohols, fatty aldehydes, natural waxes, and metal salts of fatty acids. In the ketonization step, also dicarboxylic acids or polyols including diols, may be used as additional starting material allowing longer chain lengthening than with fatty acids only. In said case, a polyketonic molecule is obtained. In the ketonization reaction, the pressure ranges from 0 to 10 MPa, preferably from 0.1 to 5 MPa, particularly preferably from 0.1 to 1 MPa, whereas the temperature ranges between 10 and 500° C., preferably between 100 and 400° C., particularly preferably between 300 and 400° C., the feed flow rate WHSV being from 0.1 to 10 l/h, preferably from 0.3 to 5 l/h, particularly preferably from 0.3 to 3 l/h. In the ketonization step optionally supported metal oxide catalysts may be used. Typical metals include Na, Mg, K, Ca, Sc, Cr, Mn, Fe, Co, Ni, Cu, Zn, Sr, Y, Zr, Mo, Rh, Cd, Sn, La, Pb, Bi, and rare earth metals. The support is typically laterite, bauxite, titanium dioxide, silica and/or aluminium oxide. The metal is preferably molybdenum, manganese, magnesium, iron and/or cadmium, the support being silica and/or alumina. Particularly preferably the metal is molybdenum, manganese and/or magnesium as oxide in a catalyst without support. No special catalysts are needed for the ketonization of metal salts of fatty acids (soaps), since the metal present in the soap promotes the ketonization reaction.

Aldol Condensation

In the aldol condensation reaction the aldehydes and/or ketones in the feed are condensed to give hydroxy aldehyde, or hydroxy ketone, followed by cleavage of water yielding unsaturated aldehyde or unsaturated ketone with carbon number of at least C18, depending on feed. Feed comprising at least one component selected from the group consisting of saturated or unsaturated aldehydes, ketones, hydroxy aldehydes and mixtures hereof, preferably saturated aldehydes and ketones are used. The reaction is carried out in the presence of homogeneous or heterogeneous aldol condensation catalyst. Supported alkali metal catalysts like $Na/SiO_2$ are suitable heterogeneous catalysts and alkali or alkaline earth metal hydroxides, for instance NaOH, KOH or $Ca(OH)_2$ are suitable homogeneous catalysts. The reaction temperature ranges from 80 to 400° C., preferably lower temperature is used with lower molecular weight feeds and higher temperatures with higher molecular weight feeds. Optionally solvents such as alcohols may be used. The amount of the homogeneous catalyst to be used in the reaction varies from 1 to 20%, preferably from 1.5 to 19%, by weight. Alternatively, reaction conditions of the aldol condensation may be adjusted to yield hydroxyaldehydes such as aldols as the reaction products, thus minimizing oligomerization based on the reaction of double bonds. Branched unsaturated aldehydes or ketones having carbon number of at least C18 are obtained.

Alcohol Condensation

In alcohol condensation reaction, suitably the Guerbet reaction, alcohols in the feed are condensed to substantially increase the carbon number of the hydrocarbon stream, thus yielding branched monofunctional and branched polyfunctional alcohols having carbon number of at least C18 respectively from monohydroxy and polyhydroxy alcohols. Feed comprising primary and/or secondary, saturated and/or unsaturated alcohols, preferably saturated alcohols is subjected to condensation in the presence of basic catalysts of the Guerbet reaction, selected from hydroxides and alkoxides of alkali and alkaline earth metals and metal oxides, in combination with a co-catalyst comprising metal salt. The amount of the basic catalyst varies from 1 to 20%, preferably from 1.5 to 10% by weight. Suitable co-catalysts include salts of chromium(III), manganese(II), iron(II), cobalt(II), lead(II) and palladium, stannic oxide and zinc oxide, the salts being salts soluble in water or alcohols, preferably sulphates and chlorides. The co-catalyst is used in amounts varying between 0.05 and 1%, particularly preferably between 0.1 and 0.5%, by weight. Hydroxides or alkoxides (alcoholates) of alkali metals, together with zinc oxide or palladium chloride serving as the co-catalyst, are preferably used. The reaction is performed at 200-300° C., preferably at 240-260° C., under vapour pressure provided by the alcohols present in the reaction mixture. Water is liberated in the reaction, said water being continuously separated.

Radical Reaction

In the radical reaction, carbon chains of the saturated carboxylic acids in the feed are lengthened with alpha olefins. In the radical reaction step, the feedstock comprising saturated carboxylic acids and alpha olefins in a molar ratio of 1:1 are reacted at 100-300° C., preferably at 130-260° C. under a vapor pressure provided by the reaction mixture, in the presence of an alkyl peroxide, peroxyester, diacylperoxide or peroxyketal catalyst. Alkyl peroxides such as ditertiary butyl peroxide catalysts are preferably used. The amount of the catalyst used in the reaction is from 1 to 20%, preferably from 1.5 to 10%, by weight. A branched carboxylic acid having carbon number of at least C18 is obtained as the reaction product.

Condensation Product

The carbon number of the condensation product depends on the carbon number of the feed molecules as well as the condensation reaction. Typical carbon numbers of condensation products obtained using the ketonization reaction are the sum of the carbon numbers of the feed molecules minus one; the carbon numbers of the products obtained using the other condensation reactions are sum of the carbon numbers of the feed molecules. Preferably the feed contains only 1-3 feedstock compounds of different hydrocarbon chain length; that is for example either only C16, or only C18, or only C20, or C16/C18 etc., or C16/C18/C20. Therefore, the width of carbon number range of the condensation product is typically not more than 9. The feed to the condensation step is selected so that the carbon number of the condensation product is at least C18.

Combined Hydrodefunctionalization and Isomerization (CHI)

The above obtained saturated and/or unsaturated condensation product comprising monofunctional and/or polyfunctional compounds having carbon number of at least C18, selected from ketones, aldehydes, alcohols and carboxylic acids and corresponding sulphur compounds, corresponding nitrogen compounds and combinations thereof is then subjected to combined hydrodefunctionalization and isomerization step (CHI) in the presence of a bifunctional molecular sieve catalyst comprising an acidic function (molecular sieve) and a hydrogenation metal, optionally on a binder. A binder means here carrier or support.

Catalyst

A preferred catalyst in the combined hydrodefunctionalization and isomerization (CHI) step enables dewaxing by isomerizing n-paraffinic wax molecules to isoparaffins with boiling points in the base oil range. In the CHI step a bifunctional molecular sieve catalyst is used. The catalyst comprises a molecular sieve, hydrogenation/dehydrogenation metal and an optional binder.

The molecular sieve is selected from crystalline silicoaluminophosphates and aluminosilicates, preferably comprising framework type selected from AEL, TON, and MTT. The molecular sieve may have one-dimensional channel system, comprising parallel pores without intersecting pores, with pore openings around 4-7 Å, without crossing channels, which induce strong cracking activity. Preferably the crystalline molecular sieves contain at least one 10-ring channel and they are based on aluminosilicates (zeolites), or on silicoaluminophosphates (SAPO). Examples of suitable zeolites containing at least one 10-ring channel include ZSM-11, ZSM-22, ZSM-23, ZSM-48, EU-1 and examples of suitable silicoaluminophosphates containing at least one 10-ring channel include SAPO-11 and SAPO-41. Preferred catalysts include SAPO-11 and ZSM-23. SAPO-11 may be synthetized according to the EP 0 985 010. ZSM-23 may be synthetized according the patent WO 2004/080590.

The molecular sieves are typically composited with binder materials, resistant to high temperatures and suitable for employing under dewaxing conditions to form a finished catalyst, or it may be binderless (self-bound). The binder materials are usually inorganic oxides such as silica, alumina, silica-alumina, and binary combinations of silica with other metal oxides such as titania, magnesia, thoria, zirconia, and the like, and tertiary combinations of these oxides such as silica-alumina-thoria and silica-alumina magnesia. The amount of the molecular sieve in the finished catalyst is from 10 to 100 wt. %, preferably 15 to 80 wt. % based on the catalyst.

Said catalysts are bifunctional, i.e., they are loaded with at least one metal dehydrogenation/hydrogenation component, selected from Group 6 metals of the Periodic Table of Elements, Group 8-10 metals and mixtures thereof. Preferable metals are Groups 9-10 metals. Particularly preferable are Pt, Pd and mixtures thereof. The metal content in the catalyst varies from 0.1 to 30 wt. %, preferably from 0.2 to 20 wt. % based on catalyst. The metal component may be loaded using any suitable known methods, such as ion exchange and impregnation methods using decomposable metal salts.

Process Conditions

The condensed product is subjected to the combined hydrodefunctionalization and isomerization step under a pressure ranging from 0.1 to 15 MPa, preferably from 1 to 10 MPa, and particularly preferably from 2 to 8 MPa, at a temperature ranging between 100 and 500° C., preferably between 200 and 400° C., and particularly preferably between 300 and 400° C., the flow rate WHSV being between 0.1 and 10 l/h, preferably between 0.1 to 5 l/h, and particularly preferably between 0.1 and 2 l/h, the hydrogen to liquid feed ratio being between 1 and 5000 Nl/l (normal liter per liter), preferably between 10 to 2000 Nl/l, and particularly preferably between 100 and 1300 Nl/l, in the presence of the above described bifunctional molecular sieve catalyst. A fixed catalyst bed reactor, for instance the trickle-bed reactor is suitable for the reaction.

Hydrofinishing

Optionally the product obtained from the CHI step may be subjected to hydrofinishing in order to adjust product qualities to desired specifications. Hydrofinishing is a form of mild hydrotreating directed to saturating any lube range olefins as well as to removing any remaining heteroatoms and colour bodies. Suitably the hydrofinishing is carried out in cascade with the previous step. Typically the hydrofinishing is carried out at temperatures ranging from about 150° C. to 350° C., preferably from 180° C. to 250° C. in the presence of a hydrofinishing catalyst. Total pressures are typically from 3 to 20 MPa (about 400 to 3000 psig). Weight hourly space velocity (WHSV) is typically from 0.1 to 5 l/h, preferably 0.5 to 3 l/h and hydrogen treat gas rates of from 1 to 2000 Nl/l.

Hydrofinishing catalysts are suitably supported catalysts containing at least one metal selected from Group 6 metals of the Periodic Table of Elements, Groups 8-10 metals and mixtures thereof. Preferred metals include noble metals having a strong hydrogenation function, especially platinum, palladium and mixtures thereof. Mixtures of metals may also be present as bulk metal catalysts wherein the amount of metal is 30 wt. % or greater based on catalyst. Suitable supports include low acidic metal oxides such as silica, alumina, silica-aluminas or titania, preferably alumina.

After the optional finishing step, the product is passed to a distillation and/or separation unit in which product components boiling over different temperature range and/or product components intended for different applications are separated from each other.

Product

The saturated base oil according to the invention, comprising saturated branched hydrocarbons typically having carbon number of at least C18, may be produced from feed comprising starting materials of biological origin by the methods resulting in the lengthening of the carbon chain of the starting material molecules to the level necessary for the base oils. Due to the relatively long hydrocarbon main chain and controlled level of branching, the viscosity and cold properties of the product of invention are very good.

The base oils of the invention have kinematic viscosity KV100 ranging from 2 $mm^2/s$ to 6 $mm^2/s$. The kinematic viscosity (KV100) for the heavier base oils having carbon number higher than C26 and boiling range higher than 413° C. is about 4-6 $mm^2/s$, and the viscosity index (VI) is about 140-165 when the pour point (PP) is from about −8 to −20° C. For the lighter process oils with the carbon number of C21-26 and boiling range between 356-413° C., the kinematic viscosity (KV100) is about 3-4 $mm^2/s$ and the VI is about 135-150 when the PP ranges from about −8 to −24° C.

The product obtained according to the invention contains saturated hydrocarbons having carbon number of at least C18 and it is substantially free of aromatics. Said product comprises at least 90%, preferably at least 95%, and particularly preferably at least 97%, and at best 99% by weight of saturated hydrocarbons. Saturated hydrocarbons are determined by FIMS as paraffins, mononaphtenes etc. Typically the paraffins are 100% i-paraffins, because C18 and longer n-paraffins are solid at room temperature, and thus they would not be suitable as base oils. Thus the product comprises particularly i-paraffins and contains not more than 5%, preferably not more than 1% by weight of linear n-paraffins.

In addition to i-paraffins, the base oils of the invention, having kinematic viscosity KV100 from 2 $mm^2/s$ to 6 $mm^2/s$ comprise mono- and dinaphthenes, but typically no polycyclic naphthenes, and the dinaphthenes thereof being non-fused. Based on the FIMS analysis, the product contains less than 20 FIMS %, preferably less than 10 FIMS %, particularly preferably less than 5 FIMS % of mononaphthenes, and less than 2.0 FIMS %, preferably less than 1.0 FIMS %, and particularly preferably less than 0.5 FIMS % of polycyclic naphthenes.

For base oils of the invention, having kinematic viscosity KV100 from 3 $mm^2/s$ to 6 $mm^2/s$ the viscosity index is at least 120 and preferably at least 140, particularly preferably at least 150, and at best at least 165 (ASTM D 2270). The pour point is not more than −2° C., preferably not more than −12° C. and particularly preferably not more than −15° C. (ASTM D 97/5950).

Width of the carbon number range of base oils of the invention is no more than 9 carbons, preferably no more than 7 carbons, particularly preferably no more than 5 carbons, and at best 3 carbons (FIMS). More than about 50 FIMS %, preferably more than 75 FIMS % and particularly preferably more than 90 FIMS % of the base oil contain hydrocarbons belonging to this narrow carbon number range.

For base oil of the invention the volatility of product, having KV100 from 3 $mm^2/s$ to 6 $mm^2/s$, is lower than that of commercial VHVI and PAO products in same viscosity range. This means that the volatility of product is no more than 2271.2*(KV100)-3.5373% by weight as determined by the method of DIN 51581-2 (Mathematical Noack method based on ASTM D 2887 GC distillation).

Low temperature dynamic viscosity, CCS-30, for base oils according to the invention is no more than 29.797* $(KV100)^{2.7848}$ cP, preferably no more than 34.066* $(KV100)^{2.3967}$ cP; CCS-35 is no more than 36.108* $(KV100)^{3.069}$ cP, preferably no more than 50.501* $(KV100)^{2.4918}$ cP measured by method ASTM D 5293.

The base oils of the invention, based on biological starting materials, contain carbon $^{14}C$ isotope, which may be considered as an indication of the use of renewable raw materials. Typical $^{14}C$ isotope content (proportion) of the total carbon content in the product, which is completely of biological origin, is at least 100%. Carbon $^{14}C$ isotope content is determined on the basis of radioactive carbon (carbon $^{14}C$ isotope) content in the atmosphere in 1950 (ASTM D 6866).

Advantages

The process according to the invention has several advantages. The obtained base oil originates from feedstock based on renewable natural resources. Starting materials of the process of the invention are available all over the world, and moreover, the utilization of the process is not limited by significant initial investments in contrast for instance to the GTL technology where Fischer-Tropsch waxes are produced.

When compared to the technically available processes, the process of the invention comprises a combination of a condensation reaction step with a combined hydrodefunctionalization and isomerization step (CHI). The combined process is an economic and efficient way of producing base oils from renewable sources.

In the condensation reaction the basic hydrocarbon chain length of the feed molecules is increased to essentially reach the viscosity ranges required for base oil applications (for example KV100 of 2-4, and 4-6 $mm^2/s$, and even heavier by recycling the condensation product).

The process according to the invention utilizes renewable starting materials of biological origin containing heteroatoms particularly for producing base oils, and also diesel and gasoline components. In addition to traditional crude oil, a completely new raw material source for high-quality branched paraffinic base oils is now provided.

The obtained base oil products are carbon dioxide neutral with respect to the use and disposal thereof, that is, they will not increase the carbon dioxide load of the atmosphere in contrast to products derived from fossil starting materials.

According to the process of the invention, base oil containing only carbon and hydrogen is obtained, the stability of said base oil in humid conditions being higher than that of esters or other base oils originating of renewable natural resources and containing heteroatoms. A paraffinic hydrocarbon component is not decomposed as easily as esters forming corrosive acids. In addition, the oxidation stability of the saturated base oil is higher than that of ester base oil containing unsaturated fatty acid structural units.

A nonpolar and fully saturated hydrocarbon component, free of sulphur and other heteroatoms is obtained.

An additional advantage of the base oil according to this invention is that it fulfils the API group III base oil specifications. Therefore it can be used in engine oil formulations like other group III base oils according the same interchanging rules without need to perform new engine tests.

The specifications for finished lubricants require base oils with excellent low temperature properties, high oxidation stability and low volatility. Generally lubricating base oils are base oils having kinematic viscosity of about 3 $mm^2/s$ or greater at 100° C. (KV100); a pour point (PP) of about −12° C. or less; and a viscosity index (VI) about 120 or greater. In addition to low pour points also the low-temperature fluidity of multi-grade engine oils is needed to guarantee that in cold weather the engine starts easily. The low-temperature fluidity is demonstrated as apparent viscosity in cold cranking simulator (CCS) tests at −5 to −40° C. temperature. Lubricating base oils having KV100 of about 4 cSt should typically have CCS viscosity at −30° C. (CCS-30) lower than 1800 cP and oils having KV100 of about 5 cSt should have CCS-30 lower than 2700 cP. The lower the value is the better. The base oils of invention have extremely low low-temperature fluidity. In general, lubricating base oils should have Noack volatility no greater than current conventional Group I or Group II light neutral oils.

The product obtained by the process of the invention is mainly isoparaffinic. Therefore the viscosity index is extremely high and pour point is relatively low. In addition, naphthenes of the final product of the invention are mononaphthenes and non-fused dinaphthenes. In the Slack wax and VHVI products of the prior art, the dinaphthenes are mainly fused. The VI of fused naphthenes is poorer than that of non-fused naphthenes. It is known that the non-fused naphthene rings are desirable as components of base oils since their VI is reasonably high but the pour point low.

In addition to pour point and viscosity index, the relationship of isoparaffins and 1-2 ring naphthenes to 3-6 ring naphthenes seem to play the major role in cold cranking. If too high amount of multiring naphthenes are present, they give higher CCS-30 values since they are present as an extremely viscous liquid. Furthermore, if normal paraffins are present after hydroisomerization, they give high CCS-30 values by crystallization and thus inhibiting the liquid to flow. Multiring naphthenes are missing in the product of invention, thus its low temperature fluidity is enhanced compared to mineral base oils.

The base oil according to the invention has high viscosity index, which leads to a significantly decreased need of high price additives like Viscosity Index Improvers (VII) or in other terms Viscosity Modifiers (VM). It is commonly known, that the VM causes highest amounts of deposits in vehicle engines. In addition, reduction of the amounts of VII results in significant savings in costs.

Moreover, response of the base oil according to the invention is extremely high for antioxidants and pour point depressants, and thus the life time of the lubricating oils are longer and they can be used in the colder environment than lubricants based on the conventional base oils.

Also, because the base oil according to the invention is non-toxic, contains no sulphur, nitrogen or aromatic compounds typically present in the conventional mineral oil based products, it may more safely be used in applications where the end user is exposed to oil or oil spray.

The invention is further illustrated in the following examples, however it is evident that the invention is not limited to these examples only.

EXAMPLES

Example 1

Condensation of Fatty Acids Derived from Palm Oil to Saturated Ketones

Palm oil was hydrolyzed and double bonds of the fatty acids derived from palm oil feedstock were selectively prehydrogenated. The obtained saturated fatty acid was continuously ketonised at atmospheric pressure, in a tubular reactor using a $MnO_2$ catalyst. Temperature of the reactor was 370° C., the weight hourly space velocity (WHSV) of total feed being about 0.8 l/h ($h^{-1}$). A mixture of saturated ketones having carbon chain lengths of $C_{31}$, $C_{33}$ and $C_{35}$ was obtained as the product.

Example 2

Condensation of C16 Alcohol Derived from Palm Oil 200 g of primary saturated C16 fatty alcohol (hexadecanol), palladium chloride (5 ppm palladium) and 12 g of sodium methoxylate were put in a Parr reactor. Mixing was adjusted to 250 rpm, temperature to 250° C. and pressure to 0.5 MPa. Slight nitrogen purge was maintained to sweep out water liberated in reaction. The condensation reaction was carried out until the amount of condensed alcohol was stabilized in GC analysis. After reaction the product was neutralized with hydrochloric acid, washed with water and dried with calcium chloride. Condensed C32 alcohol was obtained as reaction product.

Example 3

Condensation of Fatty Acids Derived from Palm Oil to Unsaturated Ketones

Free fatty acids were distilled from palm oil (PFAD). The feed containing both saturated and unsaturated fatty acids was continuously ketonised at atmospheric pressure, in a tubular reactor using a $MnO_2$ catalyst. Temperature of the reactor was 370° C., the weight hourly space velocity (WHSV) of total feed being about 0.6 l/h. A mixture of both saturated and unsaturated ketones having carbon chain lengths of C31, C33 and C35 was obtained as the product.

Example 4

Condensation of Stearic Acid Fraction ($C_{17}H_{35}COOH$) to Saturated Ketones A mixture of plant oils (linseed oil, soy oil, and rapeseed oil) was pretreated by hydrolysis and distillation to obtain fatty acid fractions according to carbon numbers and the double bonds of the C18 acid fraction were selectively prehydrogenated. The obtained stearic acid was continuously ketonised at atmospheric pressure, in a tubular reactor using a $MnO_2$ on alumina catalyst. Temperature of the reactor was 360° C., the WHSV of the feed being 0.9 l/h. Saturated C35 ketone with 12 wt. % unconverted stearic acid was obtained as the product.

Example 5

Combined Hydrodefunctionalization and Isomerization of Saturated Palm Ketone Feed, obtained by ketonization according to example 1, was subjected to combined hydrodefunctionalization and isomerization. In the feed the C35 ketone contained about 3.16 wt. % of oxygen, the C33 ketone contained 3.34 wt. % of oxygen and the C31 ketone contained 3.55 wt. % of oxygen and the palm ketone contained about 3.4 wt. % of oxygen. The CHI step was carried out in the presence of a Pt/ZSM-23 catalyst on alumina binder, at a temperature of 345° C. and under a pressure of 4 MPa, using hydrogen to hydrocarbon ($H_2$/HC) ratio of 950 Nl/l and weight hourly space velocity (WHSV) of 1.1 l/h. The obtained fractions, gas/gasoline, diesel, base oil lighter fraction (process oil) (356-413° C.) and base oil heavier fraction (>413° C.) were distilled as separated fractions under reduced pressure. In this example the base oil fraction was cut at higher temperature, thus KV100 was 5.7 $mm^2/s$. The process conditions and product distribution are presented in Table 2. Hydrocarbon (HC) distribution is calculated from the organic product phase, and water is calculated from the palm ketone feed. The product contained mainly methyl branched isoparaffins and about 3-7% of mononaphtenes. Table 3 shows physical properties of the base oil fractions.

TABLE 2

Process conditions in CHI step and product distribution

| Catalyst | Reactor T, P | $H_2$/HC | WHSV |
|---|---|---|---|
| Pt/HZSM-23 | 345° C., 4 MPa | 950 | 1.1 |

| Gas $C_{1-4}$ | Gasoline $C_{5-10}$ | Diesel $C_{11-20}$ | Process oil $C_{21-26}$ | Base oil heavier fraction $>C_{26}$ | $H_2O$ |
|---|---|---|---|---|---|
| 20.9% | 15.4% | 20.5% | 7.0% | 36.2% | 3.4% |

TABLE 3

| Base oils produced from palm oil fatty acid | | | |
|---|---|---|---|
| Method | Analysis | Fraction > 413° C. | Fraction 356-413° C. |
| ASTM D 4052 | Density@15° C., kg/m$^3$ | 822 | 811 |
| ASTM D 5950 | Pour Point, ° C. | −17 | −24 |
| ASTM D 445 | KV40, mm$^2$/s | 26.5 | 12.3 |
| ASTM D 445 | KV100, mm$^2$/s | 5.7 | 3.3 |
| ASTM D 445 | VI | 162 | 140 |
| DIN 51581-2 | GC Noack | 2.6 | 21.4 |
| ASTM D 2887 | GC dist., ° C. | | |
| | 10% | 448 | 368 |
| | 50% | 464 | — |
| | 90% | 524 | 436 |
| Saturated HC* (FIMS %) | paraffins | 96 | 93 |
| | mononaphtenes | 4 | 7 |
| | dinaphtenes | 0 | 0 |
| | polycyclic naphthenes | 0 | 0 |
| Paraffins | i-paraffins % | 100 | 100 |
| | n-paraffins % | 0 | 0 |

*HC = hydrocarbons

Example 6

Combined Hydrodefunctionalization and Isomerization of Saturated Palm Ketone Feed obtained by ketonization according to example 1 was subjected to combined hydrodefunctionalization and isomerization step. The catalyst employed in the CHI step was Pt/SAPO-11 on alumina binder. The process was carried out at a temperature of 365° C. and under a pressure of 4 MPa, using $H_2$/HC ratio of 1250 Nl/l and WHSV of 0.8 l/h. The process conditions and product distribution are presented in Table 4. Hydrocarbon distribution is calculated from the organic phase, and water is calculated from the palm ketone. The physical properties of the produced base oil fractions are presented in Table 5.

TABLE 4

| Process conditions in CHI and product distribution | | | |
|---|---|---|---|
| Catalyst | Reactor T, P | $H_2$/HC | WHSV |
| Pt/SAPO-11 | 365° C., 4 MPa | 1250 | 0.8 |

| Gas $C_{1-4}$ | Gasoline $C_{5-10}$ | Diesel $C_{11-20}$ | Process oil $C_{21-26}$ | Base oil heavier fraction $>C_{26}$ | $H_2O$ |
|---|---|---|---|---|---|
| 7.8% | 3.5% | 28.2% | 10.7% | 49.7% | 3.4% |

TABLE 5

| Base oils produced from palm oil fatty acid | | | |
|---|---|---|---|
| Method | Analysis | Fraction > 413° C. | Fraction 356-413° C. |
| ASTM D 4052 | Density@15° C., kg/m$^3$ | 819 | 810 |
| ASTM D 5950 | Pour Point, ° C. | −15 | −21 |
| ASTM D 445 | KV40, mm$^2$/s | 21.7 | 11.4 |
| ASTM D 445 | KV100, mm$^2$/s | 4.9 | 3.1 |
| ASTM D 445 | VI | 157 | 139 |
| DIN 51581-2 | GC Noack | 6.0 | 28.9 |
| ASTM D 2887 | GC dist., ° C. | | |
| | 10% | 414 | 348 |
| | 50% | 456 | 391 |
| | 90% | 475 | 455 |

TABLE 5-continued

| Base oils produced from palm oil fatty acid | | | |
|---|---|---|---|
| Method | Analysis | Fraction > 413° C. | Fraction 356-413° C. |
| Saturated HC (FIMS %) | paraffins | 81 | 87 |
| | mononaphtenes | 17 | 12 |
| | dinaphtenes | 1 | 1 |
| | polycyclic naphthenes | 1 | 1 |
| Paraffins | i-paraffins % | 100 | 100 |
| | n-paraffins % | 0 | 0 |

Example 7

Combined Hydrodefunctionalization and Isomerization of Alcohol

Feed comprising branched C32 alcohol, 2-tetradecyl-oktadecanol, obtained from condensation of C16 fatty alcohols by the alcohol condensation (Guerbet) reaction according to example 2 was subjected to CHI step. The C32 alcohol contained about 3.43 wt. % of oxygen. The CHI step was carried out in the presence of a catalyst comprising Pt/ZSM-23 on alumina binder, at a temperature of 366° C. and under a pressure of 4.2 MPa, using $H_2$/HC ratio of 2000 Nl/l and WHSV 0.5 l/h. The process conditions and product distribution are presented in Table 6. The physical properties of produced base oil fractions are presented in Table 7.

TABLE 6

| Process conditions in CHI and product distribution | | | |
|---|---|---|---|
| Catalyst | Reactor T, P | $H_2$/HC | WHSV |
| Pt/ZSM23 | 366° C., 4.2 MPa | 2000 | 0.5 |

| Gas $C_{1-4}$ | Gasoline $C_{5-10}$ | Diesel $C_{11-20}$ | Process oil $C_{21-26}$ | Base oil heavier fraction $>C_{26}$ | $H_2O$ |
|---|---|---|---|---|---|
| 13.5% | 5.5% | 27.1% | 18.6% | 35.2% | 3.4% |

TABLE 7

| Base oils produced from C16 fatty alcohol | | | |
|---|---|---|---|
| Method | Analysis | Fraction > 413° C. | Fraction 356-413° C. |
| ASTM D 5950 | Pour Point, ° C. | −21 | −24 |
| ASTM D 445 | KV40, mm$^2$/s | 18.8 | 11.1 |
| ASTM D 445 | KV100, mm$^2$/s | 4.4 | 3.0 |
| ASTM D 445 | VI | 147 | 135 |
| DIN 51581-2 | GC Noack | 8.5 | 30.9 |
| ASTM D 2887 | GC dist., ° C. | | |
| | 10% | 405 | 346 |
| | 50% | 443 | — |
| | 90% | 453 | 444 |
| Saturated HC (FIMS %) | paraffins | 90 | 90 |
| | mononaphtenes | 9 | 9 |
| | dinaphtenes | 0 | 0 |
| | polycyclic naphthenes | 1 | 1 |
| Paraffins | i-paraffins % | 100 | 100 |
| | n-paraffins % | 0 | 0 |

Example 8

Combined Hydrodefunctionalization and Isomerization of Unsaturated Palm Ketone

Unsaturated palm ketone obtained by ketonization of unsaturated palm oil fatty acids according to example 3 was subjected to CHI step. In the feed the C35 ketone contained about 3.16 wt. % of oxygen, the C33 ketone contained 3.34 wt. % of oxygen and the C31 ketone contained 3.55 wt. % of oxygen and the unsaturated palm ketone contained about 3.4 wt. % of oxygen. The CHI step was carried out in the presence of a Pt/SAPO-11 catalyst on alumina binder at a temperature of 356° C. and under a pressure of 3.9 MPa, using $H_2$/HC ratio of 2000 Nl/l and WHSV 0.5 l/h. The process conditions and product distribution are presented in Table 8 below. The physical properties of produced base oil fractions are presented in Table 9.

TABLE 8

Process conditions in CHI and product distribution

| Catalyst | Reactor T, P | $H_2$/HC | WHSV |
|---|---|---|---|
| Pt/SAPO-11 | 356° C., 3.9 MPa | 2000 | 0.5 |

| Gas $C_{1-4}$ | Gasoline $C_{5-10}$ | Diesel $C_{11-20}$ | Process oil $C_{21-26}$ | Base oil heavier fraction $>C_{26}$ | $H_2O$ |
|---|---|---|---|---|---|
| 3.9% | 3.5% | 25.4% | 12.0% | 55.2% | 3.4% |

TABLE 9

Base oils produced from unsaturated palm oil fatty acids

| Method | Analysis | Fraction > 413° C. | Fraction 356-413° C. |
|---|---|---|---|
| ASTM D 4052 | Density@15° C., kg/m$^3$ | 822 | 811 |
| ASTM D 5950 | Pour Point, ° C. | −2 | −16 |
| ASTM D 445 | KV40, mm$^2$/s | 21.9 | 11.5 |
| ASTM D 445 | KV100, mm$^2$/s | 5.1 | 3.2 |
| ASTM D 445 | VI | 173 | 158 |
| DIN 51581-2 | GC Noack | 6.5 | 30 |
| ASTM D 2887 | GC dist., ° C. | | |
| | 10% | 411 | 345 |
| | 50% | 453 | — |
| | 90% | 477 | 453 |
| Saturated HC | paraffins | 87 | 87 |
| (FIMS %) | mononaphtenes | 12 | 10 |
| | dinaphtenes | 1 | 3 |
| Paraffins | polycyclic naphthenes | 0 | 0 |
| | i-paraffins % | 100 | 100 |
| | n-paraffins % | 0 | 0 |

Example 9

CHI of C35 Ketone with Residual Acidity

A mixture of ketone having carbon chain length of C35 containing about 3.16 wt. % oxygen, with 12 wt. % of stearic acid containing 11.25 wt. % oxygen, obtained by incomplete conversion in ketonization carried out according to procedure as described in example 4 was subjected to CHI in order to evaluate the influence of fatty acid on isomerization. The feed contained 4.1 wt. % of oxygen in total. The CHI process was carried out in the presence of Pt/ZSM-23 on alumina binder, at a temperature of 363° C. and under a pressure of 4.0 MPa, using $H_2$/HC ratio of 2000 Nl/l and WHSV 0.5 l/h. The process conditions and product distribution are presented in Table 10. Hydrocarbon distribution is calculated from organic phase, and water is calculated from feed ketone and fatty acid. The physical properties of produced base oil fractions are presented in Table 11.

TABLE 10

Process conditions in CHI and product distribution

| Catalyst | Reactor T, P | $H_2$/HC | WHSV |
|---|---|---|---|
| Pt/ZSM23 | 363° C., 4.0 MPa | 2000 | 0.5 |

| Gas $C_{1-4}$ | Gasoline $C_{5-10}$ | Diesel $C_{11-20}$ | Process oil $C_{21-26}$ | Base oil heavier fraction $>C_{26}$ | $H_2O$ |
|---|---|---|---|---|---|
| 6.2% | 4.0% | 37.8% | 9.0% | 43.1% | 4.1% |

TABLE 11

Base oils produced from C18 fatty acid

| Method | Analysis | Fraction > 413° C. | Fraction 356-413° C. |
|---|---|---|---|
| ASTM D 5950 | Pour Point, ° C. | −8 | −18 |
| ASTM D 445 | KV40, mm$^2$/s | 24.1 | 12.5 |
| ASTM D 445 | KV100, mm$^2$/s | 5.3 | 3.4 |
| ASTM D 445 | VI | 160 | 149 |
| DIN 51581-2 | GC Noack | 4.4 | 25.9 |
| ASTM D 2887 | GC dist., ° C. | | |
| | 10% | 422 | 351 |
| | 50% | 469 | — |
| | 90% | 477 | 468 |
| Saturated HC | paraffins | 91 | 90 |
| (FIMS %) | mononaphtenes | 9 | 8 |
| | dinaphtenes | 0 | 1 |
| | polycyclic naphthenes | 0 | 1 |
| Paraffins | i-paraffins % | 100 | 100 |
| | n-paraffins % | 0 | 0 |

Example 10 (Comparative)

Separate Hydrodefunctionalization and Isomerization with Pt/ZSM-23 Catalyst of Saturated Palm Ketone Feed obtained according to example 1 was subjected hydrodefunctionalization. The reaction was carried out with NiMo at pressure of 4.0 MPa, temperature of 265° C., WHSV 1.0 l/h, $H_2$/HC 500 Nl/l. The product was then subjected to isomerization carried out in the presence of Pt/ZSM-23 on alumina binder at a temperature of 333° C. and under a pressure of 4.0 MPa, using hydrogen to hydrocarbon ($H_2$/HC) ratio of 700 Nl/l and weight hourly space velocity (WHSV) of 1.4 l/h. The obtained gas/gasoline, diesel, process oil (356-413° C.) and base oil (>413° C.) fractions were separated by distillation. Table 12 shows the process conditions and product distribution. Hydrocarbon distribution is calculated from the organic phase. The physical properties of produced base oil fractions are presented in Table 13.

TABLE 12

| Process conditions in the isomerization step and product distribution | | | | |
|---|---|---|---|---|
| Catalyst | Reactor T, P | | $H_2$/HC | WHSV |
| Pt/ZSM23 | 333° C., 4.0 MPa | | 700 | 1.4 |
| Gas $C_{1-4}$ | Gasoline $C_{5-10}$ | Diesel $C_{11-20}$ | Process oil $C_{21-26}$ | Base oil heavier fraction $>C_{26}$ |
| 17.5% | 21.3% | 21.25 | 7.9% | 32.2% |

TABLE 13

| Physical properties of base oil fractions | | | |
|---|---|---|---|
| Method | Analysis | Fraction > 413° C. | Fraction 356-413° C. |
| ASTM D 4052 | Density@15° C., kg/m$^3$ | 822 | 810 |
| ASTM D 5950 | Pour Point, ° C. | −23 | −32 |
| ASTM D 445 | KV40, mm$^2$/s | 25.7 | 10.9 |
| ASTM D 445 | KV100, mm$^2$/s | 5.4 | 2.9 |
| ASTM D 445 | VI | 153 | 126 |
| DIN 51581-2 | GC Noack | 4.4 | 33.1 |
| ASTM D 2887 | GC dist., ° C. | | |
| | 10% | 431 | 355 |
| | 50% | 453 | 384 |
| | 90% | 497 | 415 |
| Saturated HC (FIMS %) | paraffins | 91 | 79 |
| | mononaphtenes | 9 | 19 |
| | dinaphtenes | 0 | 2 |
| | polycyclic naphthenes | 0 | 0 |
| Paraffins | i-paraffins % | 100 | 100 |
| | n-paraffins % | 0 | 0 |

Example 11 (Comparative)

Separate Hydrodefunctionalization and Isomerization with Pt/SAPO-11 Catalyst of Saturated Palm Ketone Feed obtained according to example 1 was subjected hydrodefunctionalization. The reaction was carried out with NiMo at pressure of 4.0 MPa, temperature of 265° C., WHSV 1.0 l/h and $H_2$/HC 500 Nl/l. The product of hydrodefunctionalization was then subjected to isomerization carried out in the presence of the Pt/SAPO-11 on alumina binder at a temperature of 344° C. and under a pressure of 3.9 MPa, using $H_2$/HC ratio of 2000 Nl/l and WHSV 0.5 l/h. The gas/gasoline, diesel, process oil (356-413° C.) and base oil (>413° C.) fractions were separated by distillation. The process conditions and product distribution are presented in Table 14. The physical properties of produced base oil fractions are presented in Table 15.

TABLE 14

| Process conditions in isomerization step and product distribution | | | | |
|---|---|---|---|---|
| Catalyst | Reactor T, P | | $H_2$/HC | WHSV |
| Pt/SAPO-11 | 344° C., 3.9 MPa | | 2000 | 0.5 |
| Gas $C_{1-4}$ | Gasoline $C_{5-10}$ | Diesel $C_{11-20}$ | Process oil $C_{21-26}$ | Base oil heavier fraction $>C_{26}$ |
| 6.6% | 9.5% | 39.5% | 10.4% | 34.0% |

TABLE 15

| Physical properties of base oils | | | |
|---|---|---|---|
| Method | Analysis | Fraction > 413° C. | Fraction 356-413° C. |
| ASTM D 4052 | Density@15° C., kg/m$^3$ | 819 | 808 |
| ASTM D 5950 | Pour Point, ° C. | −14 | −26 |
| ASTM D 445 | KV40, mm$^2$/s | 23.4 | 11.6 |
| ASTM D 445 | KV100, mm$^2$/s | 5.3 | 3.2 |
| ASTM D 445 | VI | 169 | 149 |
| DIN 51581-2 | GC Noack | 5.6 | 30.0 |
| ASTM D 2887 | GC dist., ° C. | | |
| | 10% | 415 | 346 |
| | 50% | 456 | — |
| | 90% | 488 | 454 |
| Saturated HC (FIMS %) | paraffins | 93 | 92 |
| | mononaphtenes | 7 | 8 |
| | dinaphtenes | 0 | 0 |
| Paraffins | polycyclic naphthenes | 0 | 0 |
| | i-paraffins % | 100 | 100 |
| | n-paraffins % | 0 | 0 |

The comparative examples 10 and 11 show production of base oils from biological origin via an alternative route with separate heteroatom hydrogenation and wax isomerization. The yield of the desired product is also enhanced by the CHI step, as shown in following example 12 where yields of products run similarly to pour point close to −15° C. were compared to each other.

Example 12

Process Yields

Figure 2:
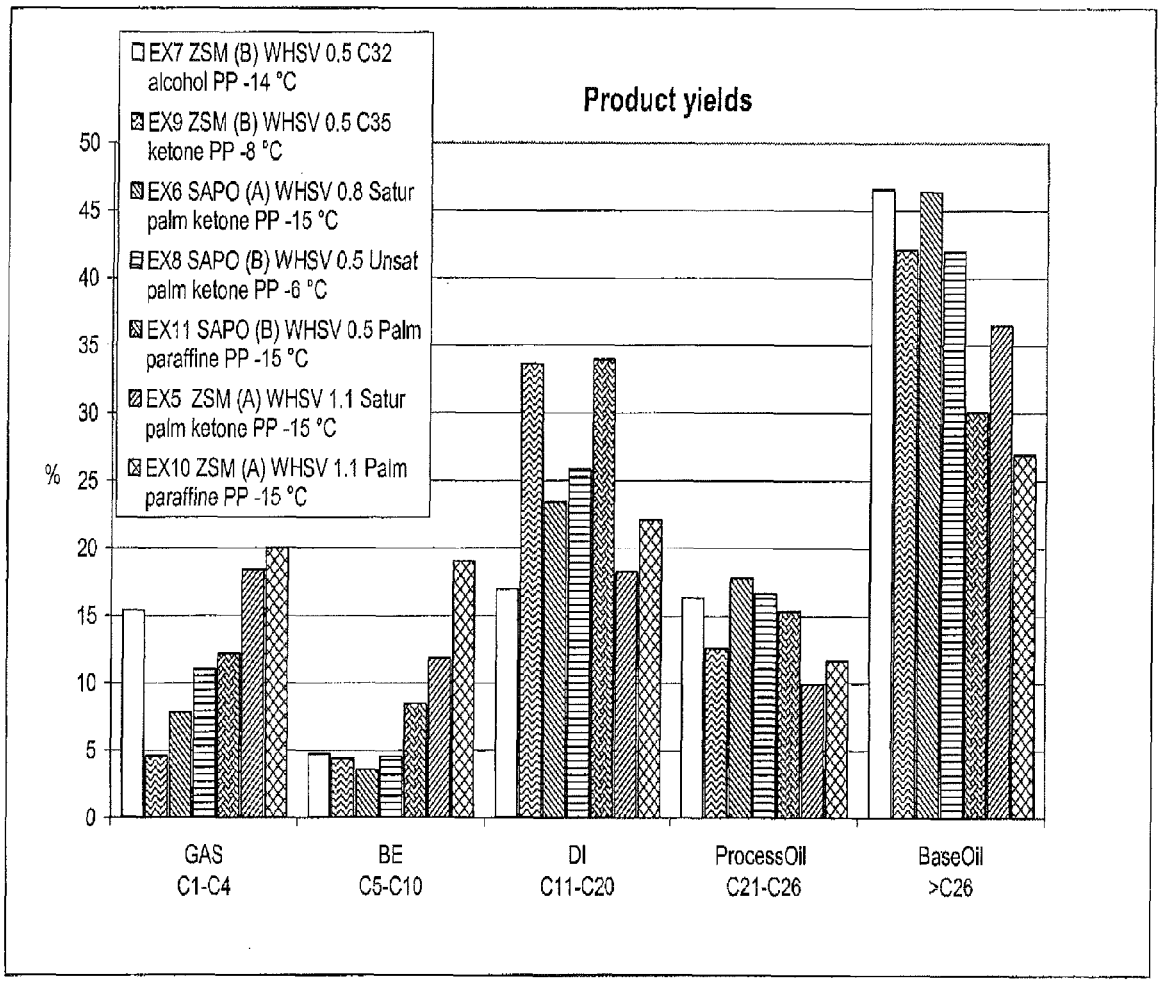
FIG. 2 presents the results of yield distribution of products according to Examples 1-11.

The yield distributions of products prepared as described in examples 1-11 were determined by GC distillation (ASTM D2887). The products were distilled to determine the pour point of the fraction boiling above 413° C. Yields of products with pour point close to −15° C. were compared to each other. Results are shown in FIG. 2. In the examples two different SAPO (A) and (B) and two different ZSM (A) and (B) catalysts were used. With the same catalyst i.e. either SAPO-11 (B) or ZSM-23 (A), the base oil yield was particularly high with ketone feed (containing C31, C33, C35 ketones) compared to corresponding palm wax feed (containing C31, C33, C35 n-paraffins). The ZSM-23 catalyst in Examples 9 and 7 (=ZSM (B)) was less acidic when compared to ZSM-23 in Examples 5 and 10 (=ZSM (A)), and therefore yield is higher in Examples 9 and 7. In Example 9 the feed contained stearic acid, and therefore amount of diesel fraction is higher.

Example 13

Carbon Number Distributions

Figure 3:
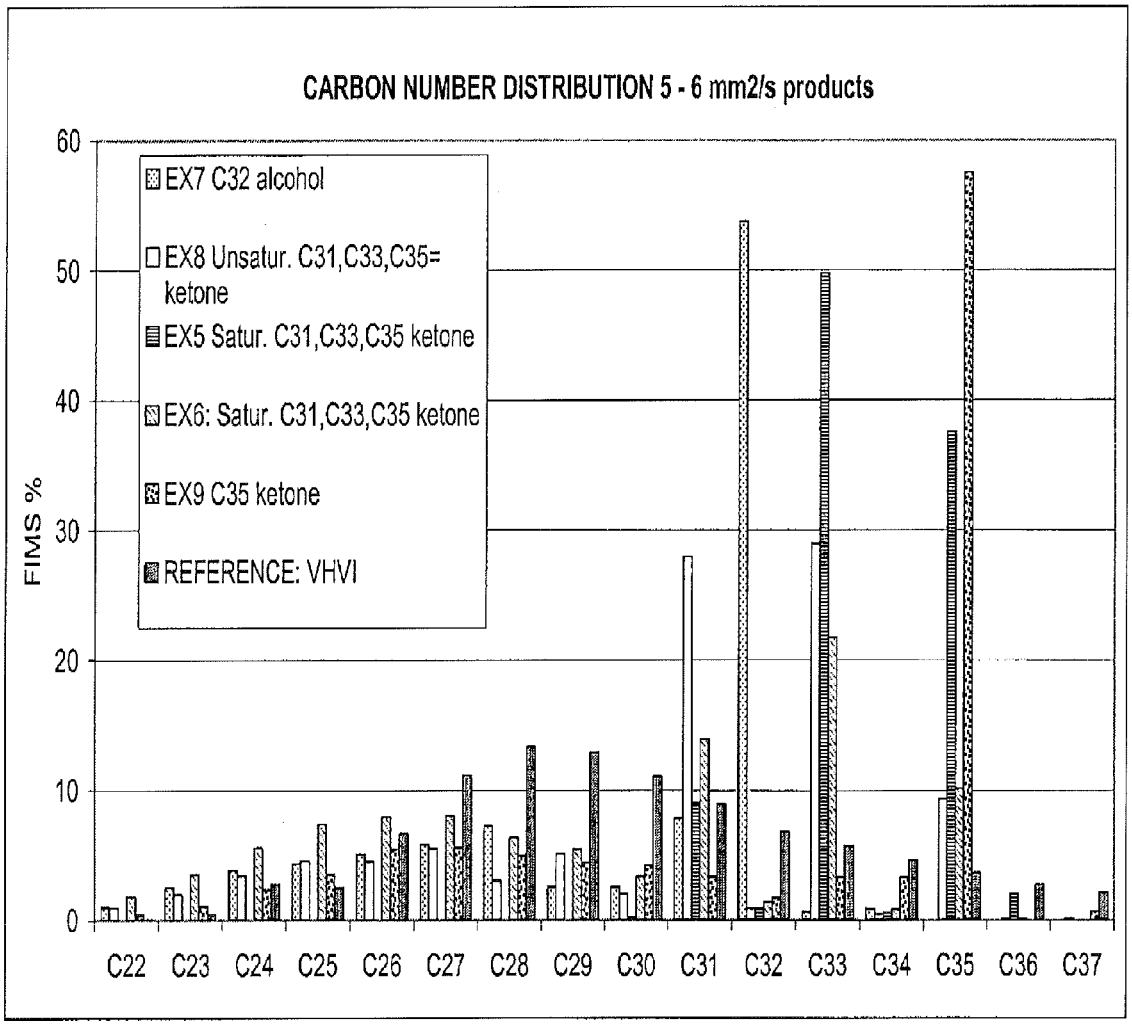
FIG. 3 presents the results of an analysis of the carbon member distributions in the base oil products.

The proportion of hydrocarbons in certain carbon number range of the base oil product is dependent on distillation. The carbon number distributions of 5 mm$^2$/s VHVI (413-520° C. cut) and the base oils of invention (>413° C. cut) are shown in FIG. 3. The carbon number distribution of the base oils according to invention is narrower than that of conventional VHVI base oil when distillation is cut in similar manner at >413° C. corresponding to C26 paraffin. The carbon number distribution of the base oil in Example 5 is the narrowest, due to high cut (448° C.) in distillation (Table 3). It contains mainly i-C35, i-C33 and i-C31.

The width of carbon number range of the final product can be calculated as the difference of the carbon numbers of the largest and the smallest molecules plus one, measured from the main peak in FIMS analysis. This means that the main peak is the centre peak and additional carbon numbers are taken around this peak so that total 3, 5, 7 and 9 peaks are taken into account. The amount of base oil in this narrow carbon number range is calculated from these peaks.

In addition to the narrow carbon number distribution, the base oils of the invention contain also higher amount of higher boiling fractions compared to the conventional product of same viscosity range (KV100 about 5 $mm/s^2$), as shown in FIG. 3 (Carbon number distributions). The lower boiling components with carbon number<C31 are due to cracking in isomerization. The higher boiling compounds enhance VI. In the base oils of the invention there is no "heavy tail". The VHVI base oil has lower boiling paraffins and higher boiling paraffins, the main peaks being C28 and C29.

Example 14

Volatilities of the Products

Figure 4:
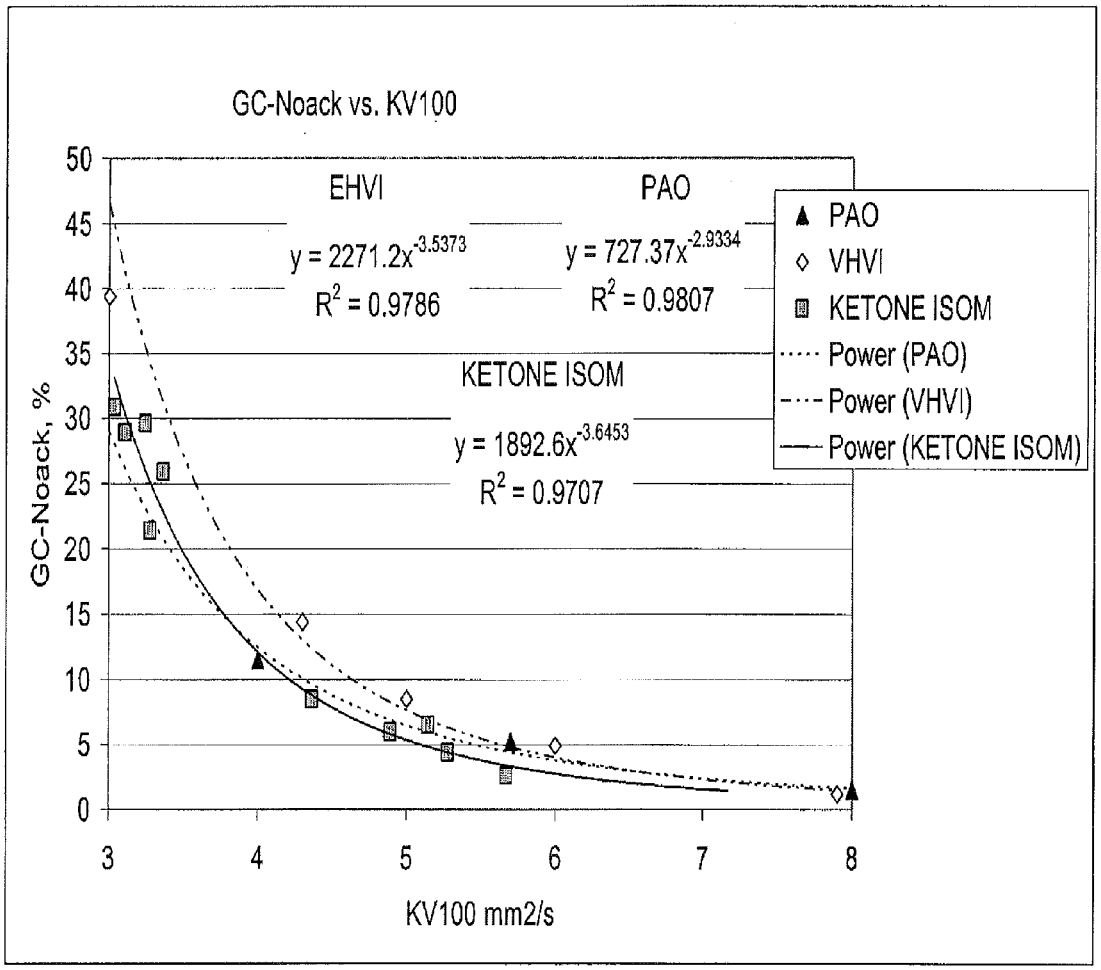
FIG. 4 presents results from analysis of the volatility of the bas oil products in Examples 5-9.

The proportion of hydrocarbons in certain carbon number range and therefore the volatility of the base oil product are dependent on distillation. Noack volatilities of PAO, VHVI and base oils of invention (=KETONE ISOM) are shown in FIG. 4. The volatility of the base oil products of the invention (=KETONE ISOM) are clearly lower than that of the PAO and VHVI. The points are obtained from base oil products in the examples 5-9, and the equations are obtained by Excel program as power function. Equations are drawn in FIG. 4 in different styles as Power (curve name) shows.

Example 14

Low-Temperature Fluidity

Low-temperature fluidity of multi-grade engine oils is needed to guarantee that in cold weather the engine starts easily. The low-temperature fluidity is demonstrated as apparent viscosity in cold cranking simulator (CCS) tests at −5 to −40° C. temperature. Lubricating base oils having KV100 of about 4 cSt should typically have CCS viscosity at −30° C. (CCS-30) lower than 1800 cP and oils having KV100 of about 5 cSt should have CCS-30 lower than 2700 cP. The lower the value is the better. In Table 16 CCS values of the product of invention made according to example 5 is compared to those of reference example 11, VHVI and PAO. The low-temperature fluidity of the product of invention is better than that of the other products in wide test range of apparent viscosity measured by cold cranking simulator (CCS) tests from −25 to −35° C. temperature.

TABLE 16

CCS values of base oils

| Method | Analysis | EX5 | EX11 | VHVI | PAO |
|---|---|---|---|---|---|
| ASTM D5293 | CCS at −25° C. (cP) | 1115 | 1138 | | |
| ASTM D5293 | CCS at −30° C. (cP) | 1830 | 1855 | 2700 | 2300 |
| ASTM D5293 | CCS at −35° C. (cP) | 3228 | 3185 | 5100 | 3850 |
| ASTM D 445 | KV100, $mm^2/s$ | 5.7 | 5.3 | 5.0 | 5.7 |

The invention claimed is:

1. A process for producing base oils, characterized in that the process comprises the steps where feedstock selected from ketones, aldehydes, alcohols, carboxylic acids, esters of carboxylic acids and anhydrides of carboxylic acids, alpha olefins, metal salts of carboxylic acids and corresponding sulphur compounds, corresponding nitrogen compounds and combinations thereof, derived from starting material of biological origin, is subjected to a condensation step and subsequently subjected to a combined hydrodefunctionalization and isomerization step.

2. The process according to claim 1, characterized in that the condensation step is selected from ketonization, aldol condensation, alcohol condensation and radical reactions.

3. The process according to claim 2, characterized in that the ketonization is carried out under the pressure from 0 to 10 MPa, at the temperature from 10 to 500° C., in the presence of supported metal oxide catalyst and the feedstock is selected from fatty acid esters, fatty acid anhydrides, fatty alcohols, fatty aldehydes, natural waxes, metal salts of fatty acids, dicarboxylic acids and polyols.

4. The process according to claim 2, characterized in that the aldol condensation is carried out in the presence of a homogeneous or heterogeneous aldol condensation catalyst at a temperature from 80 to 400° C. and the feedstock is selected from aldehydes, ketones and hydroxy aldehydes.

5. The process according to claim 2, characterized in that the alcohol condensation is carried out in the presence of a catalyst selected from hydroxides and alkoxides of alkali and alkaline earth metals and metal oxides, in combination with a co-catalyst comprising a metal at a temperature from 200 to 300° C. and the feedstock is selected from primary and/or secondary, saturated and/or unsaturated alcohols.

6. The process according to claim 2, characterized in that the radical reaction is carried out at 100 to 300° C. temperature in the presence of an alkyl peroxide, peroxyester, diacylperoxide or peroxyketal catalyst and the feedstock is selected from saturated carboxylic acids and alpha olefins in a molar ratio of 1:1.

7. The process according to claim 6, characterized in that in the combined hydrodefunctionalization and isomerization step the flow rate WHSV is from 0.1 to 10 l/h and hydrogen to liquid feed ratio is from 1 to 5000 Nl/l.

8. The process according to claim 6, characterized in that after the combined hydrodefunctionalization and isomerization step optional hydrofinishing step is carried out, and the product is passed to a distillation and/or separation unit in which product components boiling over different temperature range are separated from each other.

9. The process according to claim 6, characterized in that the feedstock is selected from ketones, aldehydes, alcohols, carboxylic acids, esters of carboxylic acids and anhydrides of carboxylic acids, alpha olefins produced from carboxylic acids, metal salts of carboxylic acids, and corresponding sulphur compounds, corresponding nitrogen compounds and combinations thereof.

10. The process according to claim 6, characterized in that the feedstock is selected from the group consisting of:

a) plant fats, plant oils, plant waxes; animal fats, animal oils, animal waxes, fish fats, fish oils, fish waxes, and b) fatty acids or free fatty acids obtained from plant fats, plant oils, plant waxes; animal fats, animal oils, animal waxes; fish fats, fish oils, fish waxes, and mixtures thereof by hydrolysis, transesterification or pyrolysis, and c) esters obtained from plant fats, plant oils, plant waxes; animal fats, animal oils, animal waxes; fish fats, fish oils, fish waxes, and mixtures thereof by transesterification, and d) metal salts of fatty acids obtained from plant fats, plant oils, plant waxes; animal fats, animal oils, animal waxes; fish fats, fish oils, fish waxes, and mixtures thereof by saponification, and e) anhydrides of fatty acids from plant fats, plant oils, plant waxes; animal fats, animal oils, animal waxes; fish fats, fish oils, fish waxes, and mixtures thereof, and f) esters obtained by esterification of free fatty acids of plant, animal and fish origin with alcohols, and g) fatty alcohols or aldehydes obtained as reduction products of fatty acids from plant fats, plant oils, plant waxes; animal fats, animal oils, animal waxes; fish fats, fish oils, fish waxes, and mixtures thereof, and h) recycled food grade fats and oils, and fats, oils and waxes obtained by genetic engineering, i) dicarboxylic acids or polyols including diols, hydroxyketones, hydroxyaldehydes, hydroxycarboxylic acids, and corresponding di- or multifunctional sulphur compounds, corresponding di- or multifunctional nitrogen compounds, and j) mixtures of said starting materials.

11. The process according to claim 1, characterized in that the combined hydrodefunctionalization and isomerization step is carried out under pressure from 0.1 to 15 MPa, at the temperature from 100 to 500° C., in the presence of a bifunctional catalyst comprising at least one molecular sieve selected from aluminosilicates and silicoaluminophosphates and at least one metal selected from Group 6 and 8-10 metals of the Periodic Table of Elements.

12. The process according to claim 11, characterized in that the bifunctional catalyst comprises at least one molecular sieve selected from zeolites and silicoaluminophosphates, at least one metal selected from Group 9 or 10 metals of the Periodic Table of Elements and a binder.

* * * * *